US005462117A

United States Patent [19]

Green et al.

[11] Patent Number: 5,462,117

[45] Date of Patent: Oct. 31, 1995

[54] TUBING CONVEYED PERFORATING SYSTEM WITH FLUID LOSS CONTROL

[75] Inventors: Robert R. Green, Houston; Kelly D. Ireland, The Woodlands, both of Tex.

[73] Assignee: Baker Hughes Incorporated, Houston, Tex.

[21] Appl. No.: 328,721

[22] Filed: Oct. 25, 1994

[51] Int. Cl.[6] ..... E21B 43/116; E21B 34/06

[52] U.S. Cl. ..... 166/297; 166/55.1; 166/278; 166/332.4

[58] Field of Search ..... 166/297, 386, 166/51, 332, 278, 55.1

[56] References Cited

U.S. PATENT DOCUMENTS

| | | | |
|---|---|---|---|
| Re. 32,755 | 9/1988 | Vann | 166/297 X |
| 4,299,287 | 11/1981 | Vann et al. | 166/297 |
| 4,480,690 | 11/1984 | Vann | 166/297 X |
| 4,515,217 | 5/1985 | Stout | 166/297 |
| 4,526,233 | 7/1985 | Stout | 166/377 |
| 4,540,051 | 9/1985 | Schmuck et al. | 166/278 |
| 4,541,486 | 9/1985 | Wetzel et al. | 166/297 |
| 4,616,718 | 10/1986 | Gambertoglio | 166/297 X |
| 4,813,481 | 3/1989 | Sproul et al. | 166/51 |
| 4,846,281 | 7/1989 | Clarry et al. | 166/373 |
| 4,862,964 | 9/1989 | George et al. | 166/297 |
| 5,293,940 | 3/1994 | Hromas et al. | 166/297 |
| 5,318,126 | 6/1994 | Edwards et al. | 166/297 |

*Primary Examiner*—Hoang C. Dang

*Attorney, Agent, or Firm*—Browning, Bushman, Anderson & Brookhart

[57] ABSTRACT

A reliable tubing conveyed perforating operation may be coupled with methods and equipment for substantially minimizing the loss of completion fluids, thereby allowing recovery of the expensive completion fluids and preventing damage to the formation. A one-way valve is biased for closing the interior of the tubing string, but is normally held open by a stop member structurally interconnected to the perforating gun. Upon the firing of the perforating gun, an automatic gun release mechanism allows the gun to drop in the wellbore, thereby axially dropping the stop member from a position which prevents the closure of the one-way valve. According to the method of the present invention, the tubing string above a set packer may be disconnected and picked up to isolate the tubing string from the perforating gun. The perforating gun may then be fired and, the one-way valve is automatically closed so that completion fluids above the one-way valve will not be lost in the perforations below the one-way valve.

20 Claims, 2 Drawing Sheets

TUBING CONVEYED PERFORATING SYSTEM WITH FLUID LOSS CONTROL

FIELD OF THE INVENTION

The present invention relates to systems for perforating a formation for the recovery of hydrocarbons using a perforating gun suspended in the wellbore from a tubular string. Methods and apparatus are employed for minimizing the loss of wellbore fluids present when perforating the well, and for effectively allowing the well to be produced anytime after perforating the casing and without damaging the formation with further fluid losses.

BACKGROUND OF THE INVENTION

Tubing conveyed perforating systems have been widely used during the past decade for economically perforating a well. As disclosed in U.S. Pat. Nos. 4,299,287 and 4,480,690, a perforating gun may be conveyed to its desired depth in the wellbore from a tubular string, the perforating gun fired, and the produced fluid recovered at the surface via the same tubing string. Those skilled in hydrocarbon recovery recognize that tubing conveyed perforating has particular advantages for many wells compared to perforating systems which suspend the perforating gun in the wellbore from a wireline. Perforating guns may be percussion fired by dropping a weight through the tubular string to activate the gun, or may be hydraulically fired by increasing downhole pressure to rupture a fluid barrier disk and thereby fire the gun.

Many oil recovery operations benefit from a gravel packing technique whereby gravel is placed in the borehole across the perforated area of the well casing and is forced into the formation a short distance through the perforated casing. Gravel packing filters out sand produced with the fluids, thereby minimizing sand production. U.S. Pat. Nos. 4,450,051 and 4,541,486 disclose a combined perforating and gravel packing operation which may be performed in one "trip" of the tubular and gravel packing operation which may be performed in one "trip" of the tubular string, thereby reducing the time and cost of the completion process. Toward the end of the gravel packing operation, a one-way flapper valve may be used to prevent pressurized fluid in the casing annulus from entering the bypass system around a crossover port and thereby enter the formation, as disclosed in the '051 patent. U.S. Pat. No. 4,846,281 discloses a gravel packing tool with dual flapper valves which may be used to permit a subsequent well logging operation to be performed while the tool remains within the wellbore. The dual flapper valve arrangement also conserves completion fluid, and allows the producing formation to be protected from the pressure of the column of heavy completion fluid during retrieval of the work string and installation of the production string. U.S. Pat. No. 4,813,481 discloses further particulars with respect to a flapper valve and a sealing seat used in downhole tools.

While the one trip perforating and gravel packing technique as disclosed in the above patents has reduced the cost of completion in various applications, this technique has some drawbacks which have limited its acceptance in the industry. In some cases, the shock generated by firing the perforating guns may actuate or damage other tools in the completion string. Various types of shock absorbers have been placed in the tool string above the perforating guns to minimize this problem. These shock absorbers systems are not always effective and inherently increase the cost of the completion operation. In other applications using tubing conveyed perforating gun, tools may need to be isolated from the gun shock.

Those skilled in gravel packing and perforating operations also appreciate the substantial damage which may be caused by subjecting the formation to well completion fluids during the completion operation. After gravel packing, the completion fluid may be circulated to the surface through the tubing to both avoid squeezing the gravel pack and to displace the service fluid used during well treatment. The pressure required for circulating the completion fluid may thus adversely affect the subsequent production operation. Moreover, hundreds of barrels of completion fluid may be lost into a well, and the cost of the base completion fluid and the fluid additives are a significant cost to the overall completion operation. While techniques as disclosed in U.S. Pat. No. 4,846,281 have been devised to both minimize formation damage and prevent loss of completion fluids in the annulus of the wellbore after gravel packing, large quantities of completion fluids are still lost in many tubing conveyed perforating operations, and this lost fluid adversely affects the efficiency of the oil recovery operation.

The disadvantages of the prior art are overcome by the present invention, and improved techniques are hereinafter disclosed for a tubing conveyed perforating operation which both minimizes the possible damage to the formation and minimizes the loss of expensive completion fluids.

SUMMARY OF THE INVENTION

According to the technique of the present invention, a perforating gun is suspended in a well from a tubular string, with a biased flapper valve or other one-way valve being provided above the gun. The perforating gun may be activated by dropping a bar through the tubular string, which passes by the open flapper valve. Alternatively, the gun may be hydraulically activated by increasing fluid pressure to rupture a barrier disk. In either event, pressure caused by firing of the gun automatically releases the perforating gun from the tubing string, and the gun drops within the wellbore. The gun is mechanically interconnected with a probe or similar upper member of the gun firing head which normally holds the biased flapper valve open. Dropping of the gun thus drops the probe, allowing the biased flapper valve to close and seal on its seat.

According to the method of the present invention, a lower packer, a one-way valve assembly, and the gun system may be run in the wellbore, optionally with gravel packing tools provided above the lower packer. Completion fluid may then be circulated through the casing annulus and the interior of the production tubing, and the lower packer can be set to isolate the annulus. The completion string above the lower packer may then be mechanically disconnected, and the disconnected upper portion of the completion string picked up to prevent the transmission of shock through the completion string when the gun is subsequently fired. The gun may be fired as described above, and the gun automatically dropped into the rat hole, thereby closing the flapper valve. The combination of the set lower packer and the closed flapper valve thus prevents fluid losses above these components from entering the perforated formation. The completion string may then be reconnected, and the perforated zone may be produced, if desired, or the lower packer may be released and moved down hole. The perforated zone thereafter may be gravel packed in a conventional manner. Substantially less fluid loss into the formation will result compared to prior art techniques, thereby minimizing formation damage and saving costly completion fluid.

It is an object of this invention to provide improved tubing conveyed perforating techniques which minimize the loss of completion fluids. A related object of this invention is to minimize formation damage caused by loss of completion fluids used in the tubing conveyed perforating operations.

Another object of this invention is obtained by allowing for a time separation between the tubing conveyed perforating operation and the subsequent recovery of produced fluids, without adversely affecting the efficiency of the recovery operation.

It is a feature of this invention that the techniques for both perforating a well and for controlling fluid loss may be used when firing a perforating gun by dropping a bar through the tubing string to fire the perforating gun, or when hydraulically firing the perforating gun.

Yet another feature of this invention is that the tubing conveyed perforating and fluid loss operations may be performed with or without a gravel packing operation.

Yet another feature of this invention is that the perforating gun dropping operation is mechanically coupled to the flapper valve closing operation, so that the flapper valve will not close before the perforating gun is dropped, but will reliably close when the perforating gun is dropped.

A significant advantage of the present invention relates to the substantial savings achieved by minimizing fluid loss after the tubing conveyed perforating gun is fired.

A further advantage of this invention relates to the minimization or elimination of substantial damage to components within the tubular string above the perforating gun attributable to shock when the perforating gun is fired. A related advantage of the invention is that tools within the wellbore above the tubing conveyed perforating gun are not inadvertently activated by the gun firing operation.

These and further objects, features, and advantages of the present invention will become apparent from the following detailed description, wherein reference is made to the figures in the accompanying drawings.

BRIEF DESCRIPTION OF THE PREFERRED EMBODIMENTS

Figure 1:
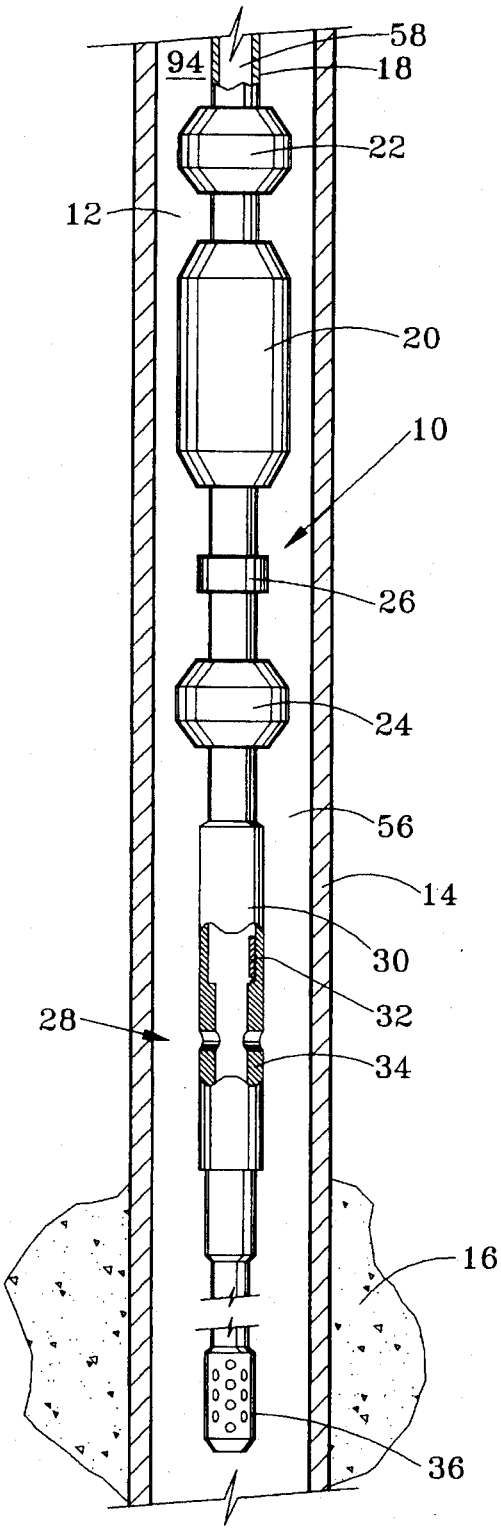
FIG. 1 is a simplified elevation view, partially in cross-section, of a lower portion of a tubular string including gravel packing tool, a tubing conveyed perforating gun, and a flapper valve for fluid loss control according to the present invention.

FIG. 1 depicts in a simplified form one embodiment of an assembly 10 within a wellbore for performing a perforating operation and a subsequent gravel packing operation while minimizing loss of completion fluids. The assembly 10 as shown in FIG. 1 may be run in a wellbore 12 formed within casing 14 which extends through formation 16, from which hydrocarbons are to be recovered. The assembly 10 is suspended in the wellbore 12 from a production tubing string 18 which extends to the surface. The assembly 10 may optionally include a conventional gravel packing tool 20 generally depicted in FIG. 1, which functionally may be similar to the tool disclosed in U.S. Pat. No. 4,540,051. One or more other downhole tools, such as packer 22, may be positioned along the tubing string 18 above the gravel packing tool.

According to the present invention, the conventional hookwall packer 24 is provided below a tubing disconnect member 26. Member 26 may be a conventional on-off tool, or may be a downhole disconnect device of the type used to selectively separate and reconnect tubulars. The perforating gun assembly 28 is suspended below the packer 24 from the tubing 18, and includes a gun firing head 30, a flapper valve 32, an automatic gun release 34, and a perforating gun 36, each simplistically shown in FIG. 1.

Figure 2:
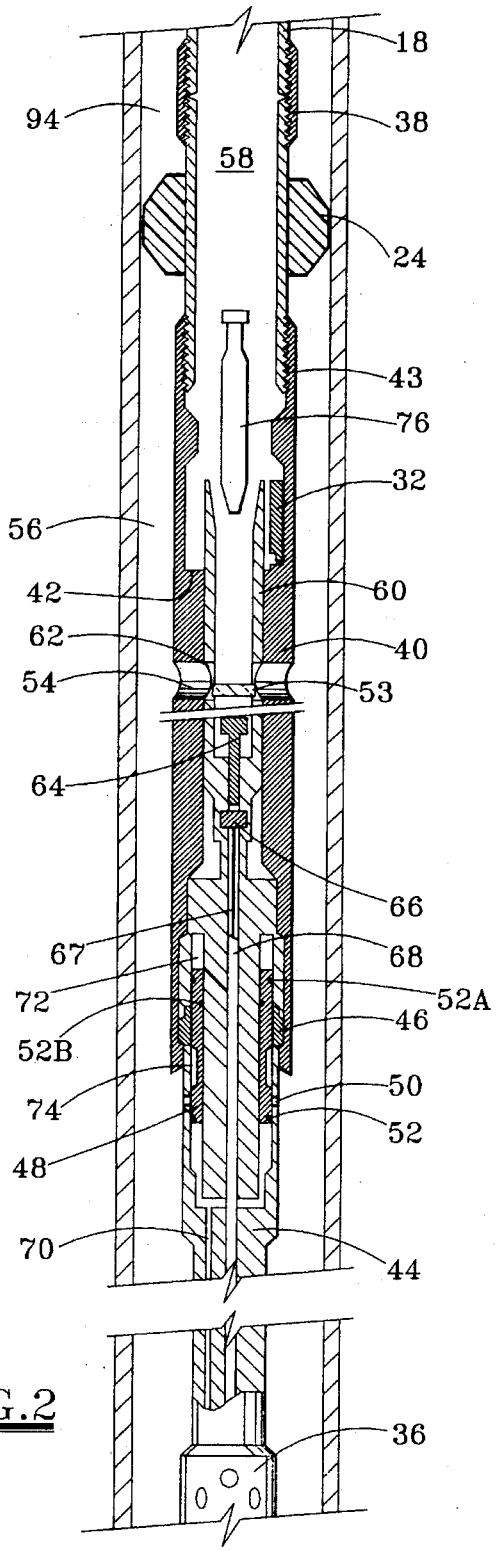
FIG. 2 is a detailed cross-sectional view illustrating a perforating gun according to the present invention prior to activation by a dropped bar, and illustrating the packer set above the flapper valve.

FIG. 2 illustrates in greater detail a suitable embodiment of the gun assembly generally shown in FIG. 1. The same reference numerals are hereafter used for components previously described. The disconnect generally shown in FIG. 1 is replaced by a conventional threaded collar 38. The gun firing head generally shown in FIG. 1 includes an outer generally sleeve-shaped housing 40 connected at threads 43 to the tubing 18. The flapper valve 32 is mounted to housing 40, and is shown in FIG. 2 in its open position, but is continually biased closed for sealing with annular seat 42 formed on the housing 40. Firing head member 44 is mechanically connected to the lower end of housing 40 by a plurality of circumferentially spaced keys 46, which in turn are held radially outward by piston sleeve 48. Piston sleeve 48 is normally held in the position as shown in FIG. 2 by a shear pin 50, with 0-ring seals 52, 52A, and 52B providing a static seal between the piston sleeve 48 and the firing head member 44.

Housing 40 includes one or more flow ports 54 which cooperate with flow passageways 62 in the upper end extension 60 of the firing head member 44 for maintaining fluid communication between the annulus 56 below the set packer 24 and the interior 58 of the tubular string 18. A disk 53 keeps debris in the tubing string 18 from fouling the operation of the gun firing head. A percussion firing pin 64 is positioned within a central passageway in the upper end 60 of the firing head member 44, and is positioned immediately above a percussion detonator 66. When the detonator 66 fires, cord 67 contained in the central flow path 68 in the firing head member 44 fires the gun 36 in a conventional manner. When the gun is fired, the expanding gas from the firing operation significantly increases the pressure in flow path 70 through the firing head member 44, thereby acting on the piston sleeve 48. This force then shears the pin 50 and forces the piston sleeve 48 upward into atmospheric chamber 72, which allows the keys 46 to collapse within the pockets 74 within the sleeve, thereby releasing the firing head member 44 and thus the perforating gun 36 from the housing 40.

Figure 3:
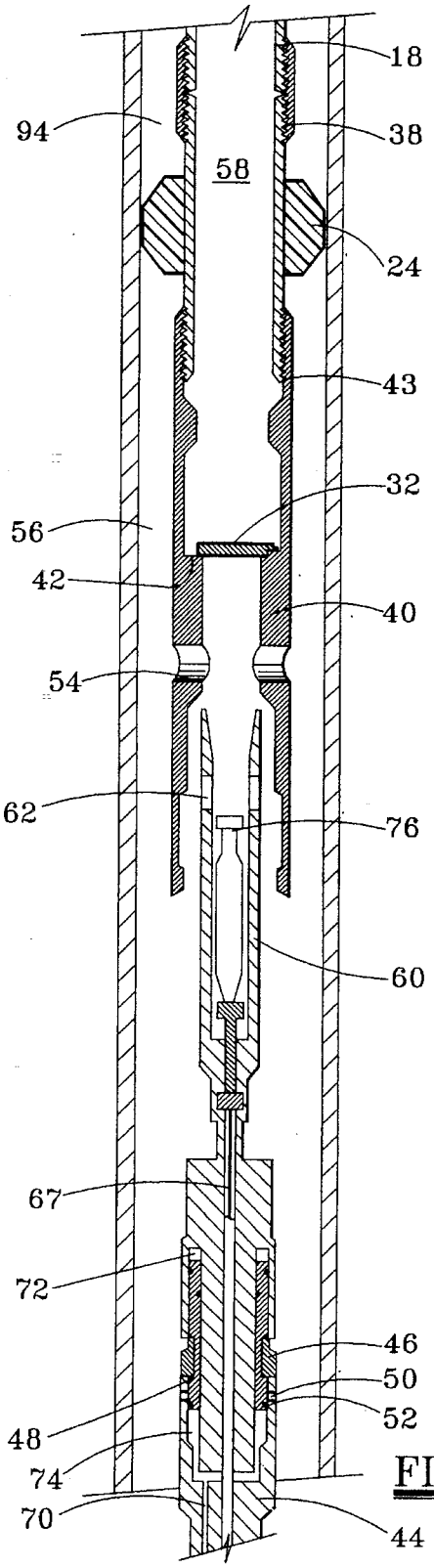
FIG. 3 illustrates the tool as shown in FIG. 2 with the perforating gun released, and the flapper valve closed to minimize fluid loss.

FIG. 2 illustrates the weighted bar 76 prior to breaking the disk 53 and striking the pin 64. Once the pin 64 is struck by the bar 76, the detonator 66 will fire, causing the gun 36 to fire and automatically releasing the gun, as shown in FIG. 3. Downward movement of the gun and thus the firing head member 44 moves the upper end member 60 from the position as shown in FIG. 2 to the position as shown in FIG. 3, so that the upper end 60 drops with the gun 36 after the perforating gun has been fired. This axially downward movement of the upper end 60 thus removes the stop which was holding the flapper valve 32 in the open position, as shown in FIG. 2. Upon firing of the gun 36, the flapper valve 32 moves into sealing engagement with flapper seat 42 due to the biasing force of a conventional flapper spring (not shown), as shown in FIG. 3. The closure of the flapper valve 32 as shown in FIG. 3 thus acts as a one-way valve to the interior 58 of the tubular string 18, while the annulus 94 above the packer 24 remains sealed by the set packer 24.

Figure 4:
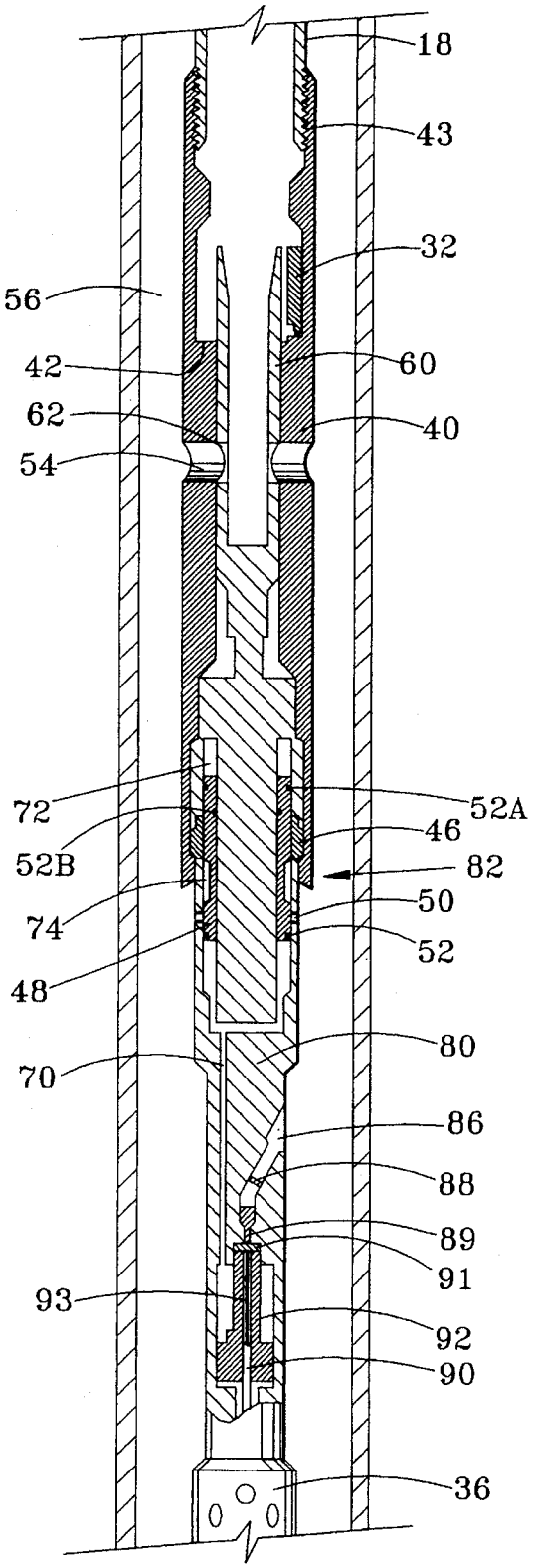
FIG. 4 is a hydraulically actuated tubing conveyed perforating gun according to the present invention.

The assembly as shown in FIG. 4 is similar in many respects to the assembly as shown in FIG. 2, although the firing head in the FIG. 4 assembly is adapted for hydraulically firing the gun 36. The housing 40 supports the flapper valve 32 as previously described, and firing head member 80 is suspended therefrom for interconnection with the lock assembly 82, including keys 46 and piston sleeve 48 as previously described. The upper end extension 60 of the firing head member 80 holding the flapper valve 32 open as previously described, so that the interior 58 of the tubing 18 is in fluid communication with the annulus 56 via the ports 54 and 62. Prior to firing the gun 36, the packer 24 may be set and pressure increased in the tubing 18, which is transmitted through ports 54 and 62 into the annulus 56. Increased tubing pressure enters flow port 86 in the firing head member 80, collapsing or rupturing a metal disk 88 when pressure reaches a substantially predetermined level. Upon rupturing of the disk 88, fluid pressure is allowed to act on the top of piston 89, which fires a detonator 91. Firing the detonator 91 detonates the cord 93 contained with flow port 90 in member 92, which then fires the tubing conveyed perforating gun 36 in a conventional manner. The firing of gun 36 then transmits the substantially high burst of pressure created by the gun firing through the flowpath 70 to axially move the piston sleeve 48 upward, thereby releasing the gun 36 and de-activating the lock assembly 82 to allow the gun to fall to a lower position in the wellbore 12. Upon firing of the gun 36, flapper valve 32 automatically closes to retain the fluid within the interior 58 of the production tubing 18.

Referring now to FIGS. 1–4, the method of the present invention will be better understood from the following description of assembly 10 within a wellbore 12 for the purpose of forming a perforating and gravel packing operation. The assembly 10 as shown in FIG. 1 may be lowered to its desired position within the wellbore 12 from the tubing string 18 in a conventional manner, and the perforating gun 36 positioned at the desired depth with respect to the formation 16 as shown in FIG. 1. At this time, the packer 24 may be set, and the entirety of the tubular string 18 and other tools above the disconnect device 26 may then be picked up to physically isolate the upper portion of the tubing string from the assembly 10 as shown in FIGS. 2 and 4. As previously noted, any type of tubular disconnect 26 as generally shown in FIG. 1 may be used to interconnect and selectively disconnect the structural connection of the tubing string 18.

At this stage, if the tubing string is still connected, the gun 36 may be fired by dropping the bar 76 as shown in FIG. 2. Alternatively, whether the tubing string is connected or disconnected, the gun 36 may be fired by increasing pressure in the tubular 18 or the annulus 56 below the set packer 24 as shown in FIG. 4. In either case, the fluid pressure will be transmitted through the interior of the set packer 24 to increase pressure in the annulus 56 to fire the gun, as previously described. Upon firing of the gun 36, the flapper valve 32 immediately closes due to the dropping of the gun 36. At this stage, the desired zone has been perforated by the tubing conveyed perforating gun 36 with the completion fluid still in the wellbore above the set packer 24 and in the tubing string 18 above the closed flapper valve 32. The gun 36 now lies at the bottom of the wellbore 12, or alternatively on top of a suitable packer or other stop member placed in the wellbore.

It is an important feature of the present invention that the operator may then produce the well in the customary manner, or alternatively may leave the well with the packer 24 remaining set, the flapper valve 32 closed, and the formation 16 perforated. At any desired later date, the well may then be completed in a usual manner. Up until the time when the well is completed, however, the formation will not be damaged by wellbore fluid losses. Depending on scheduling and costs, the perforated well may thus be gravel packed and produced, produced without gravel packing, or produced at a much later date either with or without gravel packing.

For the technique of the present invention wherein the well is produced promptly after perforating although subsequent to a gravel packing operation, tool string may include the one trip gravel packing tool 20 as generally shown in FIG. 1. Prior to gravel packing, tubular string 18 is re-connected just above the set packer 24, and the packer 24 may then be unset. The assembly as generally shown in FIG. 1 (absent the perforating gun assembly 28 which was automatically dropped when the gun is fired) may then be lowered so that the gravel packing tool 20 and gravel packing screen are positioned at the depth of the perforations caused by the gun 36, at which time the packer 22 may be set to perform a conventional gravel packing operation. When the packer 24 is first unset subsequent to the perforating operation, completion fluids in the wellbore may pass into the formation 16, so that some completion fluid is lost.

Based on the foregoing description, those skilled in the art will appreciate that various modifications to the techniques and the apparatus discussed above may be made. For example, various connecting mechanisms or locking assemblies other than the assembly 82 as shown in FIGS. 2, 3 and 4 may be used to suspend the perforating gun from the housing, and set to automatically release the perforating gun 36 when the gun fires. Also, various types of stop members other than the components as discussed above and shown in the figures may be used to hold the flapper valve 32 open. The stop member may be strutrurally interconnected in any suitable manner with the gun 36 to allow the flapper valve to close when the gun is fired and the gun drops in the wellbore. It is desirable to structurally interconnect the flapper valve stop to the head of the perforating gun, as disclosed herein, although the stop member could be movable from a stop position to a release position upon firing of the perforating gun and/or axial movement of the perforating gun without strutrurally interconnecting the perforating gun and the stop member. Similarly, the lock assembly which normally secures the perforating gun to the tubing string may selectively release the perforating gun in response to a command signal transmitted to the lock assembly, which signal is not the hydraulic signal generated by the firing of the gun. Various types of valves other than flapper valves may be used which can be biased closed for sealing the tubular string above the valve. As previously noted, the perforated technique of the present invention and the fluid loss control concepts achieved by closure of the proper valve 32 are obtained regardless of whether the perforated zone is gravel packed, and regardless of when that gravel packing occurs.

Various modifications to the equipment and to the techniques described herein should be apparent from the above description of these preferred embodiments. Although the invention has thus been described in detail for two embodiments, it should be understood that this explanation is for illustration, and that the invention is not limited to these embodiments. Alternative equipment and operating techniques will thus be apparent to those skilled in the art in view of this disclosure. Modifications are thus contemplated and may be made without departing from the spirit of the invention, which is defined by the claims.

What is claimed is:

1. A downhole assembly for suspending in a wellbore from a tubular string having a tubing flow path therein, the assembly positioned above a perforating gun suspended from a tubular string, and a packer being positioned on the tubular string above the perforating gun for sealing an annulus about the tubular string, the assembly further comprising:

a housing having a flow port therein for normally maintaining fluid communication between the tubing flow path and a lower portion of the annulus below the packer;

a flapper valve mounted on the housing, the flapper valve being biased closed for sealing the tubing flow path above the flapper valve from the tubing flow path below the flapper valve;

a lock assembly for normally suspending the perforating gun from the housing and for releasing the perforating gun upon activation of the perforating gun; and a stop member structurally interconnected to the perforating gun and normally positioned in a stop position for preventing closure of the flapper valve, such that upon firing of the perforating gun the lock assembly releases the perforating gun and the stop member is moved to a release position to close the flapper valve.

2. The assembly as defined in claim 1, wherein the stop member is a sleeve-shaped member having a central flow path therein, such that the perforating gun may be fired by passing a weight bar through the stop member to fire the perforating gun.

3. The assembly as defined in claim 1, further comprising:

a fluid barrier normally retaining fluid pressure within the lower portion of the annulus below the packer from acting on a hydraulically actuated gun firing member.

4. The assembly as defined in claim 1, further comprising:

a tubing disconnect member axially opposite the packer with respect to the perforating gun for selectively disconnecting the tubing string from the packer.

5. The assembly as defined in claim 1, wherein the lock assembly comprises an axially movable sleeve and a plurality of locking keys.

6. A downhole assembly for suspending in a wellbore from a tubular string having a tubing flow path therein, the assembly positioned above a perforating gun suspended from a tubular string, and a packer being positioned on the tubular string above the perforating gun for sealing an annulus about the tubular string, the assembly further comprising:

a valve biased closed for sealing the tubing flow path above the valve from the tubing flow path below the valve;

a lock assembly for normally suspending the perforating gun from the housing and for selectively releasing the perforating gun, from the housing; and a stop member movable in response to axial movement of the perforating gun, with respect to the housing, the stop member normally positioned in a stop position for preventing closure of the valve, such that axial movement of the perforating gun with respect to the housing moves the stop member to close the valve.

7. The assembly as defined in claim 6, the assembly being in responsive to a pressure signal generated by firing a perforating gun.

8. The assembly as defined in claim 6, wherein the stop member is structurally interconnected with the perforating gun.

9. The assembly as defined in claim 6, wherein the valve is a one way flow flapper valve.

10. The perforating gun assembly as defined in claim 6, wherein the stop member is a sleeve-shaped member having a central flow path therein, such that the perforating gun may be fired by passing a weight bar through the stop member to fire the perforating gun.

11. The perforating gun assembly as defined in claim 6, further comprising:

a fluid barrier normally retaining fluid pressure within the lower portion of the annulus below the packer from acting on a hydraulically actuated gun firing member.

12. The perforating gun assembly as defined in claim 6, further comprising:

a tubing disconnect member axially opposite the packer with respect to the perforating gun for selectively disconnecting the tubing string from the packer.

13. The perforating gun assembly as defined in claim 6, wherein the lock assembly comprises an axially movable sleeve and a plurality of locking keys.

14. A method of perforating and producing a well, comprising:

suspending a perforating gun in a wellbore from a tubular string;

setting a packer positioned on the tubular string for sealing an annulus about the tubular string;

firing the perforating gun;

releasing the fired perforating gun from the tubular string; and automatically closing valve for sealing a tubular a, flowpath within the tubular string in response to releasing the fired perforating gun.

15. The method as defined in claim 14, further comprising:

disconnecting the tubular string structurally from the set packer prior to firing the perforating gun.

16. The method as defined in claim 14, further comprising:

positioning a gravel packing tool within the tubing string above the packer.

17. The method as defined in claim 16, further comprising:

after firing the perforating gun, releasing the set packer; and thereafter lowering the gravel packing tool within the wellbore.

18. The method as defined in claim 17, further comprising:

the step of releasing the set packer includes releasing a lower set packer; and thereafter setting an upper packer to seal an annulus about the tubular string.

19. The method as defined in claim 14, wherein the step of releasing the fired perforating gun includes:

automatically generating a pressure in signal response to firing the perforating gun; and automatically releasing the perforating gun in response to the generated pressure signal.

20. The method as defined in claim 14, wherein the step of closing the valve comprises:

positioning a flapper valve within the tubular string; and structurally interconnecting a stop member to the perforating gun, such that upon release of the perforating gun the stop member is moved to a released position to close the flapper valve.

* * * * *

UNITED STATES PATENT AND TRADEMARK OFFICE

CERTIFICATE OF CORRECTION

PATENT NO. : 5,462,117

DATED : October 31, 1995

INVENTOR(S) : Robert R. Green and Kelly D. Ireland

It is certified that error appears in the above-indentified patent and that said Letters Patent is hereby corrected as shown below:

In column 8, line 38, after "closing" insert --a-- and after "tubular" delete "a,".

Signed and Sealed this

Ninth Day of January, 1996

*Attest:*

Bruce Lehman

BRUCE LEHMAN

*Attesting Officer*

*Commissioner of Patents and Trademarks*